United States Patent [19]

Zenel

[11] 4,376,941

[45] Mar. 15, 1983

[54] ANTENNA CABLE

[75] Inventor: Joseph A. Zenel, Princeton, N.J.

[73] Assignee: The United States of America as represented by the Secretary of the Navy, Washington, D.C.

[21] Appl. No.: 14,829

[22] Filed: Jan. 29, 1970

[51] Int. Cl.[2] ..... H01Q 1/34

[52] U.S. Cl. ..... 343/709; 343/895

[58] Field of Search ..... 343/709, 714, 723, 787, 343/788, 791, 895, 903, 710

[56] References Cited

U.S. PATENT DOCUMENTS 3,229,295 1/1966 Watkin et al. ..... 343/709

*Primary Examiner*—Theodore M. Blum

*Attorney, Agent, or Firm*—Richard S. Sciascia; Robert W. Adams

[57] ABSTRACT

A distributed loop antenna is embodied in a flexible cable structure for submarine E.L.F. (extremely low frequency) radio reception. Several distributed loop and magnetic core configurations which provide "side-looking" reception are described, as is the ability of flexible distributed loops to minimize the induction of noise voltages in the antenna.

7 Claims, 3 Drawing Figures

ANTENNA CABLE

BACKGROUND OF THE INVENTION

This invention relates to antennas for the reception of electromagnetic energy in radio communication and more particularly to such apparatus that is to be used by submarines in a submerged state for the reception of energy in the E.L.F. (extremely low frequency) range, the upper limit of which may be regarded as 10 kilohertz. At such low frequencies the wavelengths within seawater are comparable in dimension to the length of the submarine so that the effect of the submarine on an associated antenna system cannot be ignored.

The desirability of long range radio communication in the E.L.F. band is predicated on the well known fact that the longer wavelengths more readily penetrate the ocean medium, are less affected by atmospheric conditions, and are less subject to natural and contrived interference.

Prior submarine antenna systems, such as described in U.S. Pat. Nos. 1,557,049 to Hammond; 2,840,700 to Browder; 3,229,295 to Watkin et al; 3,121,229 to A. Silverstein; and 3,372,395 to H. W. Kline are concerned with V.L.F. (very low frequency) reception, which term has been used in the past to include all frequencies below 30 kilohertz. In practice, however, the frequencies used were above the 10 kilohertz level which may now be considered to be the upper limit of the E.L.F. band. It has been found that the antenna systems and configurations which were effective for reception of the V.L.F. frequencies above 10 kilohertz are not well suited to reception in the lower frequencies now referred to as E.L.F.

It is desirable, as noted by the Browder patent, to have a submarine antenna system for submerged use which is as close as possible to being omni-directional in its capability. This has been accomplished, in V.L.F. systems for example, by utilizing a pair of spaced electrodes as antenna means to provide for reception from directions aligned with the electrode pairs while using a helically coiled conductor as "side-looking" antenna means. However, those systems which include helically coiled, side-looking antennas such as disclosed by the Silverstein and Kline patents, comprise loops or windings which are so structurally supported that all portions of the loops, turns, or windings must move as an entire unit. Movements in the earth's magnetic field will produce a voltage in each loop or turn which is exactly in phase with that in other turns. In the usual instances where the movements are oscillatory or vibratory in nature, e.g. from vibrations induced from the submarine's machinery or propellers, buffeting by passing water currents, and the like, there results noise voltages being produced which, in the case of E.L.F. systems, are highly degrading to good reception.

BRIEF SUMMARY OF THE INVENTION

With the foregoing in mind, it is a principal object of this invention to provide an improved antenna for underwater reception of E.L.F. radio transmissions.

It is another object of this invention to provide, in an E.L.F. antenna cable, means having side-looking capability.

Still another object of this invention is the provision, in an antenna cable of the foregoing character, of side-looking antenna means which minimizes reception noise resulting from vibration, oscillation, turbulence and the like.

As another object this invention aims to accomplish the foregoing through the use of an antenna loop which is distributed along a substantial portion of a flexible cable, for example in the form of a helical winding, and which distributed loop is adapted to be flexed and moved such that portions of the distributed loop are laterally displaced in opposite directions at the same time so that noise voltages generated in those portions act to cancel one another.

BRIEF DESCRIPTION OF THE DRAWINGS

The invention may be further summarized as residing in certain constructions and arrangements of parts whereby the foregoing objects and advantages are achieved, as well as others which will become apparent from the following detailed description of preferred embodiments thereof when read in conjunction with the accompanying drawings forming a part of this application, and in which.

DESCRIPTION OF THE PREFERRED EMBODIMENT

Figure 1:
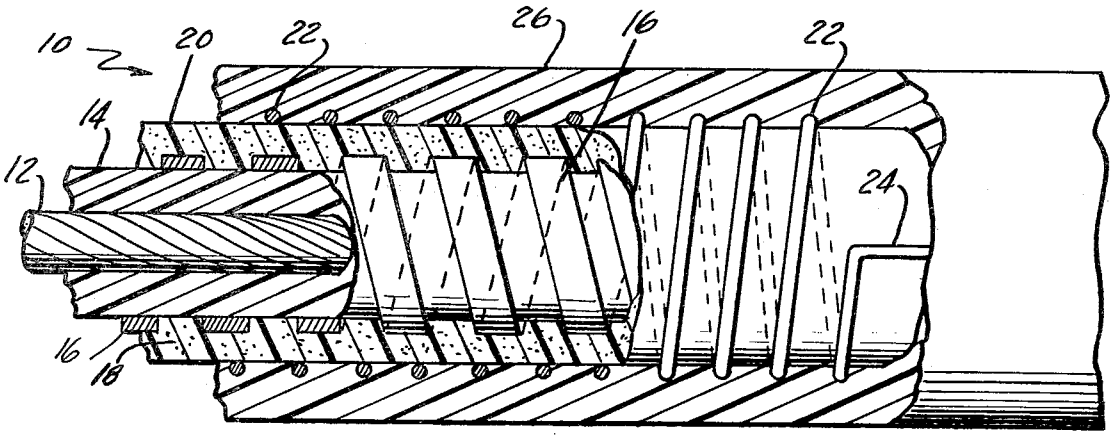
FIG. 1 is a view partly in section and partly in elevation, on an enlarged scale, of a portion of antenna cable embodying the present invention.

In the form of the invention illustrated in FIG. 1, and described hereinafter, there is provided an antenna cable 10 which is adapted to be streamed aft from a submarine hull (not shown) through an aperture therein by means of an existing cable deploying and retrieving winch.

The antenna cable 10 comprises a central, strength imparting, wire member 12 which is preferably stranded for flexibility. The wire member 12 is conveniently formed of a corrosion resistant metal, although it is not normally subject to contact by sea water due to the coverings about to be described.

A flexible, waterproof, electrically insulating covering 14 is provided about the member 12, the covering 14 being conveniently formed of polyethylene plastic, rubber, neoprene, or the like. The covering 14 is sufficiently soft and elastic to permit bending of the cable 10, including the member 12, without impairing the insulative and protective qualities of the covering 14.

Wound about the covering 14 is a helical, magnetic core 16 which is formed of a ribbon of metal alloy having a high degree of magnetic susceptability and a low degree of magnetic retentivity. Metals having such characteristics are well known to those skilled in the art to which the invention pertains and are commonly used in making cores of transformers and the like. This helical magnetic core 16 has been found to enhance the sensitivity of the antenna in reception of the E.L.F. transmissions.

A layer 18 of an electrically insulating, resilient foam plastic material, preferably a polyethylene foam, is in covering relation to the helical core 16. The foam plastic layer 18 is conveniently formed around the core 16 and the insulation 14 by the process of extrusion, during which process a surface "skin" 20 may result on the foam plastic layer.

Wound on the surface of the extruded foam plastic layer 18 is a distributed loop winding 22, the lay of which is of opposite hand with respect to the core 16. The winding 22 is formed of a conductive wire, and the turns thereof are spaced as closely as possible without incurring any likelihood of shorting out when the cable 10 is subjected to a bend of radius at least as small as required by a deploying winch. The proximate end of the winding 22 may terminate in a wire 24 which, within the submarine, may be led out of the cable 10 to a suitable connection of a radio receiving apparatus. The distal end of the winding 22 may be connected either to the strength member 12, as shown at 12*a*, for electrical connection to the receiver, or to the magnetic core 16 for the same end purpose. Phosphor bronze wire has been found suitable for the distributed loop winding 22.

A final covering layer 26 is formed over the winding 22, the layer 26 being preferably extruded into place and comprising a rather hard, yet tough and flexible covering of polyethylene plastic.

In operation, the cable 10, and hence the distributed loop winding 22, is free to flex and move under the influence of water turbulence, vibratory and oscillatory movements of the submarine, and the like. The winding 22 is distributed along such a length of the cable 10 that at no time does the entire winding 22 move laterally. Rather, portions thereof will be moving in opposite directions, whereby noise voltages generated in some portions will be in opposite phase to noise voltages generated in other portions. The net result is a cancelling of such noise voltages generated within the winding 22 so that noise voltages reaching the receiving equipment within the submarine are materially reduced.

The greater the flexibility of the cable 10 and the included distributed loop winding 22, and the greater the length thereof along which the winding 22 is distributed, the more effective will be the noise voltage cancelling effects. In this regard the length of the winding 22 along the cable must be at least several times as long as the typical length of cable segment which is laterally displaced by water turbulence, hull vibrations, or the like.

While the presently preferred embodiment as described with reference to FIG. 1 comprises a distributed loop in the form of a helical wire winding 22, and a helical magnetic core 16, the concept of a flexible distributed loop to achieve noise voltage cancellation in underwater antennas may be utilized in different embodiments of the invention. In FIG. 2 there is illustrated an embodiment of antenna cable wherein parts corresponding to parts in FIG. 1 are indicated by corresponding reference numerals with a prime mark added. In place of the distributed loop 22 as used in the cable 10, a modified distributed loop 32 is illustrated in the cable 10', the modified distributed loop comprising a plurality of conductive, closed circular loops 36, each conductively connected to a flexible wire 38. The distributed loop construction 32 is disposed between the second and third layers 14' and 18' of the cable 10', as illustrated. The loops 36 are disposed in spaced, parallel relation, each lying in a plane normal to the central axis of the cable, and the wire 38 extending generally parallel to that axis.

Figure 2:
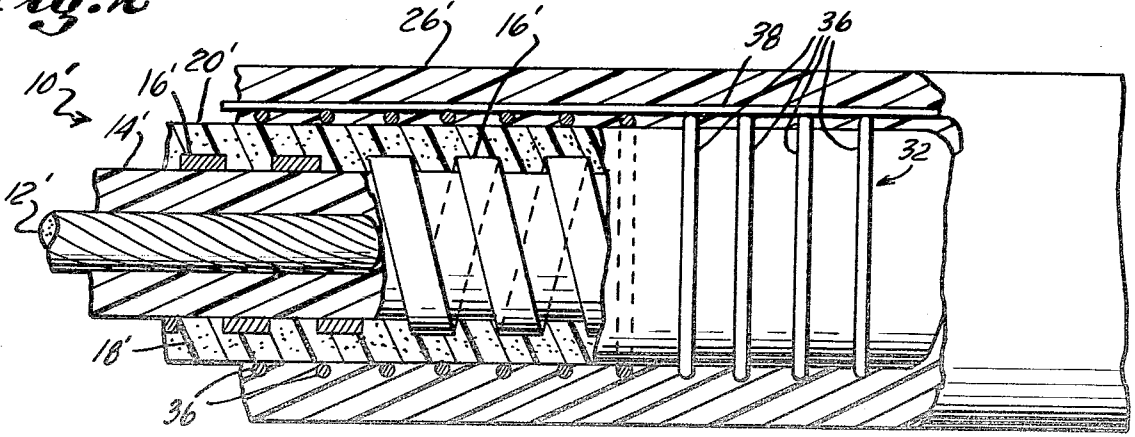
FIG. 2 is a view similar to FIG. 1, but showing an alternative form of distributed loop contemplated by the invention.
Figure 3:
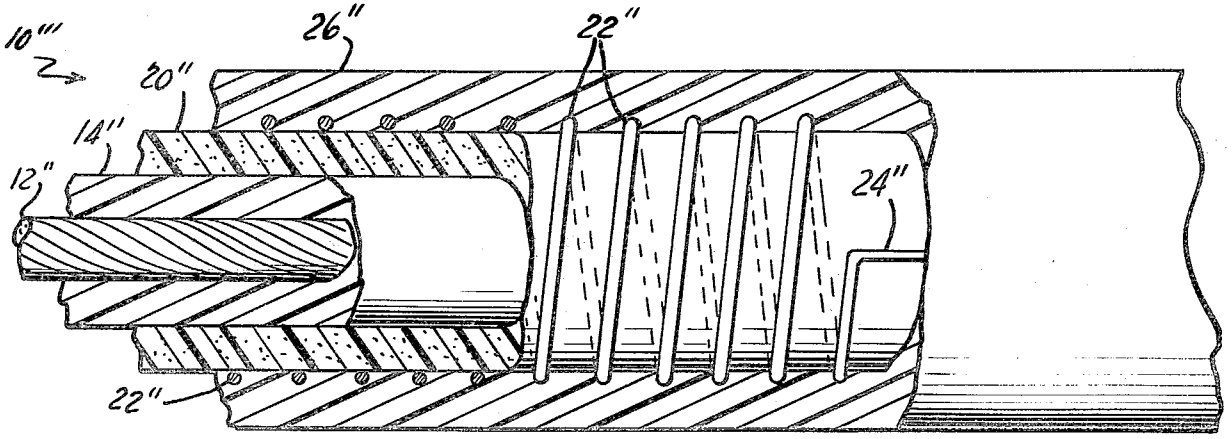
FIG. 3 is a view similar to FIG. 1, but showing another form of antenna cable embodying the invention.

Another embodiment of the invention is illustrated in FIG. 3 in which parts corresponding to parts in FIG. 1 are indicated by corresponding reference numerals with a double prime mark added. Thus, the cable 10'' comprises a helical distributed loop 22''. This embodiment differs from that of FIG. 1 in that the helical magnetic core 16 has been omitted. The central wire member 12'' may remain non-magnetic in character, in which case the distributed loop 22'' may be considered to be substantially equivalent to an air core winding. In the event it is desirable to have a magnetic core, the central wire 12'' may be formed of a suitable ferromagnetic material.

Obviously many modifications and variations of the present invention are possible in the light of the above teachings. It is therefore to be understood that within the scope of the appended claims the invention may be practiced otherwise than as specifically described.

What is claimed is:

1. A flexible antenna cable structure adapted to be streamed aft from a submarine for use in E.L.F. radio reception, said antenna cable structure comprising:

a flexible, metallic, central strength member;

a first layer overlying said strength member and formed of a flexible, electrically insulating, waterproof material;

a second layer overlying said first layer and formed of a resilient, electrically insulating foam material;

distributed loop antenna means disposed on said second layer; and a third layer surrounding said distributed loop antenna means and said second layer, said third layer being formed of a resiliently flexible, waterproof, and electrically insulating material.

2. A flexible antenna cable structure as defined in claim 1, and wherein:

said distributed loop antenna means comprises a helical wire winding between said second and third layers, said winding having the turns thereof separated, and said second and third layers being in contiguous relation between said turns.

3. A flexible antenna cable structure as defined in claim 1, and further comprising:

a magnetic core in the form of a ribbon of magnetic material helically wound between said first and second layers.

4. A flexible antenna cable structure as defined in claim 2, and further comprising:

a magnetic core in the form of a ribbon of magnetic material helically wound between said first and second layers.

5. A flexible antenna cable structure as defined in claim 4, and wherein:

said distributed loop antenna means is helically wound with a lay of opposite hand to that of said magnetic core.

6. A flexible antenna structure as defined in claim 2, and wherein:

said metallic strength member is formed of magnetic material and serves as a magnetic core for said distributed loop antenna means.

7. A flexible antenna structure as defined in claim 1, and wherein:

said distributed loop antenna means comprises a plurality of spaced, parallel, conductive rings, each of said rings lying in a plane normal to the central axis of said cable, and a flexible conductor means extending parallel to said axis and conductively connected to each of said rings.

* * * * *